US007044710B2

(12) United States Patent
Naik et al.

(10) Patent No.: US 7,044,710 B2
(45) Date of Patent: May 16, 2006

(54) GAS TURBINE ARRANGEMENT

(75) Inventors: Shailendra Naik, Gebenstorf (CH); Allewis A. Greninger, Palm City, FL (US)

(73) Assignee: ALSTOM Technology Ltd., Baden (CH)

( * ) Notice: Subject to any disclaimer, the term of this patent is extended or adjusted under 35 U.S.C. 154(b) by 30 days.

(21) Appl. No.: 10/865,842

(22) Filed: Jun. 14, 2004

(65) Prior Publication Data

US 2004/0265118 A1 Dec. 30, 2004

Related U.S. Application Data

(63) Continuation of application No. PCT/CH02/00679, filed on Dec. 9, 2002.

(30) Foreign Application Priority Data

Dec. 14, 2001 (CH) ..... 2289/01

(51) Int. Cl.
*F01D 11/02* (2006.01)

(52) U.S. Cl. ..... 415/174.4; 415/174.5; 415/230; 416/193 A

(58) Field of Classification Search ..... 415/115, 415/174.4, 174.5, 230; 416/193 A
See application file for complete search history.

(56) References Cited

U.S. PATENT DOCUMENTS

| | | | |
|---|---|---|---|
| 3,756,740 A | 9/1973 | Deich et al. | |
| 4,265,590 A | 5/1981 | Davies | |
| 4,348,157 A | 9/1982 | Campbell et al. | |
| 4,439,107 A | 3/1984 | Antonellis | |
| 4,505,640 A | 3/1985 | Hsing et al. | |
| 4,626,169 A | 12/1986 | Hsing et al. | |
| 4,820,116 A | 4/1989 | Hovan et al. | |
| 5,211,533 A | 5/1993 | Walker et al. | |
| 5,800,124 A | 9/1998 | Zelesky | |
| 5,967,745 A | 10/1999 | Tomita et al. | |
| 6,077,034 A * | 6/2000 | Tomita et al. | 415/110 |

(Continued)

FOREIGN PATENT DOCUMENTS

DE 1 942 346 3/1971

(Continued)

OTHER PUBLICATIONS

Search Report from CH 2001 2289/01 (Apr. 11, 2002).

*Primary Examiner*—Ninh H. Nguyen
(74) *Attorney, Agent, or Firm*—Cermak & Kenealy, LLP; Adam J. Cermak

(57) ABSTRACT

A gas turbine arrangement includes a rotor, a hot-gas passage, through which a hot-gas stream (12) flows while the gas turbine is operating, at least one first row of turbine blades or vanes (1), which have an airfoil(3) with a suction side (11) and a pressure side (10), and a platform (4), and at least one second row of turbine blades or vanes (2), which are arranged upstream of the first row of turbine blades or vanes (1) in the direction of the hot gases (12), and in the axial direction of the rotor and likewise have a platform (4). There is at least one seal (5, 6), through which a cooling air leakage stream (7) emerges while the gas turbine is operating, between the first row of turbine blades or vanes (1) and the second row of turbine blades or vanes (2), in the region of the respective platforms (4). An element guides the leakage stream (7) of cooling air along the surface of the platform (4) to the pressure side (10) of the first row of turbine blades or vanes (1).

11 Claims, 3 Drawing Sheets

U.S. PATENT DOCUMENTS 6,077,035 A * 6/2000 Walters et al. ..... 415/115
6,086,329 A 7/2000 Tomita et al.
6,152,690 A 11/2000 Tomita et al.

FOREIGN PATENT DOCUMENTS

DE 3523469 A1 1/1987
DE 198 60 788 A1 7/2000
EP 0 534 586 A1 3/1993
EP 1 094 200 A1 4/2001
GB 2 119 027 A 11/1983
GB 2 165 007 A 4/1986
WO 03/052240 A2 6/2003

* cited by examiner

GAS TURBINE ARRANGEMENT

This is a Continuation of, and claims priority under 35 U.S.C. 120 to, International application number PCT/CH02/00679, filed 9 Dec. 2002, and claims priority under 35 U.S.C. § 119 to Swiss application number 2001 2289/01, filed 14 Dec. 2001, the entireties of both of which are incorporated by reference herein.

BACKGROUND OF THE INVENTION

1. Field of the Invention

The invention relates to a gas turbine arrangement having a rotor and at least two rows of turbine blades or vanes, a method for operating the gas turbine arrangement, and a turbine blade or vane for use in the gas turbine arrangement.

2. Brief Description of the Related Art

On account of the temperatures of the hot gases which surround them, turbine blades and vanes of gas turbines have to be cooled. Coolable blades or vanes for gas turbines with an internal cooling system have been disclosed, for example, by laid-open specification DE-A1 198 60 788, by EP-A1 0 534 586 or by EP-A1 1 094 200. Cooling air is guided out of a cooling passage located in the rotor into the internal cooling system and is then passed through discharge openings into the flow passage of the respective gas turbine.

One major problem with cooling systems of this type is a leakage stream of cooling air which escapes between turbine blades or vanes and/or rotating and static parts of the gas turbine. Sealing devices which are supposed to minimize the cooling air leakage stream at this location are known from EP-A1 1 094 200, U.S. Pat. No. 6,152,690, U.S. Pat. No. 6,086,329, U.S. Pat. No. 4,820,116, U.S. Pat. No. 4,626,169, U.S. Pat. No. 4,505,640, U.S. Pat. No. 4,439,107, U.S. Pat. No. 4,265,590 and DE-A 1 942 346.

Other documents disclose devices which serve the purpose of minimizing the leakage stream of cooling air and of introducing the remaining stream into the hot gases of the gas turbine with the minimum possible losses and turbulence or utilizing it in some other way. In this context, mention may be made, for example, of U.S. Pat. No. 5,211,533.

Furthermore, U.S. Pat. No. 5,800,124 discloses a seal in which the leakage stream is diverted onto the trailing edge of the turbine blade or vane in order for the platform to be cooled there by impingement cooling.

U.S. Pat. No. 6,077,035 has disclosed a metal diverter sheet which prevents the leakage stream between the rotor blades and introduces the cooling air between the guide vanes and rotor blades with low losses. U.S. Pat. No. 4,348,157 has disclosed a similar device.

SUMMARY OF THE INVENTION

The aim of the invention is to avoid the abovementioned drawbacks. The invention is based on the object of providing a gas turbine arrangement in which the leakage cooling air stream is advantageously utilized for further cooling purposes. An additional object of the invention is to provide a method for operating the same gas turbine arrangement and a turbine blade or vane for use in the gas turbine arrangement.

According to the invention, the object is achieved by a gas turbine arrangement in which there are means which guide the leakage stream of cooling air along the surface of the platform to the pressure side of the first row of turbine blades or vanes.

In this way, the leakage stream of cooling air can be put to good use, since additional cooling on the pressure side of the turbine blade or vane, at which experience has shown that a locally increased temperature is established, is achieved without additional outlay for providing the cooling air, i.e. without any significant influence on the efficiency of the gas turbine.

In a first exemplary embodiment, these means may be fins which are arranged on the top side in the front region of the platform of the first row of turbine blades or vanes. To ensure that the leakage cooling air reaches the pressure side of the turbine blade or vane, the fins will advantageously extend as far as the plane in which the airfoil of the first row of turbine blades or vanes begins.

In a second exemplary embodiment, these means may comprise segmented honeycombs which form part of the seal between the two turbine blades or vanes and are arranged on the underside in the rear region of the platform of the second row of turbine blades or vanes. Individual passages, through which the leakage stream of cooling air is guided along the surface of the platform to the pressure side of the first row of turbine blades or vanes, are formed between the individual segments of the honeycombs.

The fins or the passages between the segments of the honeycombs may be straight or curved in order to achieve the object set.

According to the invention, the object is also achieved by a method for operating a gas turbine arrangement in which the leakage cooling air stream which emerges between the first and second rows of turbine blades or vanes is guided to the pressure side of the first turbine blade or vane.

According to the invention, the object is also achieved by a turbine blade or vane for use in a gas turbine arrangement by the turbine blade or vane having fins, which point in the direction of the pressure side of the turbine blade or vane, on the top side in the front region of the platform. As has already been stated, these fins may be straight or curved and may extend axially on the platform as far as the plane in which the airfoil of the turbine blade or vane begins. This advantageously prevents the leakage air from flowing away prematurely to the suction side of the turbine blade or vane.

The turbine blades or vanes in the gas turbine arrangement according to the invention and in the method according to the invention may be guide vanes or rotor blades.

BRIEF DESCRIPTION OF THE DRAWINGS

The invention is illustrated on the basis of the appended drawings, in which.

Only the elements which are pertinent to the invention are illustrated. Identical elements are provided with identical reference numerals in FIGS. 2 to 4. Directions of flow are indicated by arrows.

DETAILED DESCRIPTION OF THE PREFERRED EMBODIMENTS

Figure 1:
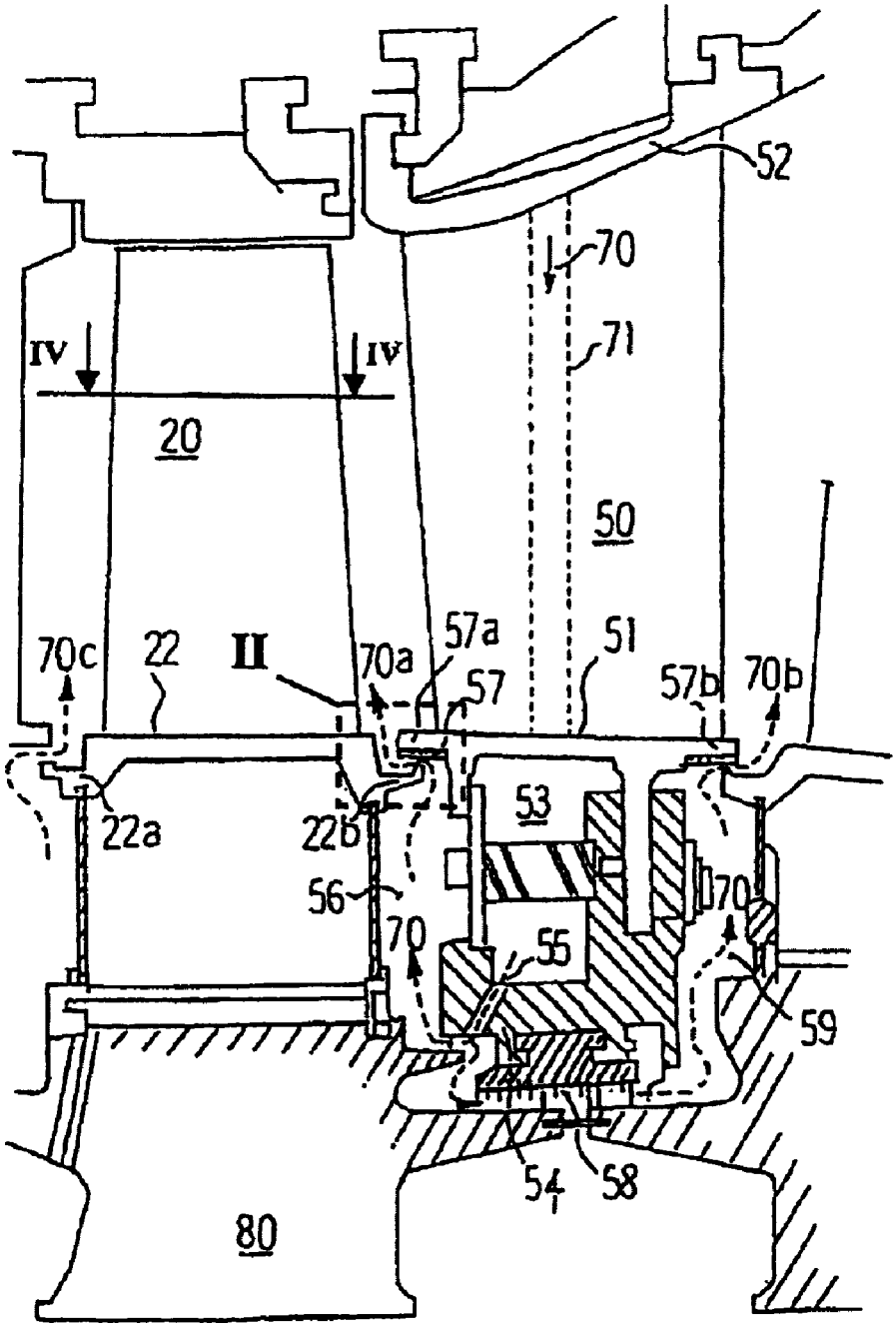
Fig.1 (Prior Art )
FIG. 1 shows an air-cooled turbine blade or vane arrangement which is known from the prior art.

FIG. 1 shows a gas turbine arrangement which is known from FIG. 5 of EP-A1 1 094 200. The gas turbine arrangement comprises a rotor, a hot-gas passage, through which hot gases flow while the gas turbine is operating, and a first and a second row of turbine blades or vanes, which are arranged in the axial direction of the rotor in the hot-gas passage.

Both guide vanes and rotor blades of the gas turbine arrangement are equipped with an internal cooling system, which is not shown in more detail in FIG. 1 and is known from the prior art. They are supplied with the cooling air from the rotor. As has already been mentioned in the prior art, a cooling air leakage stream, which is denoted by 70*a* in FIG. 1 and which flows into the hot-gas passage, is formed between the two blades or vanes. To minimize this leakage stream, there is a seal, which comprises sealing fins 22*b* and honeycombs 57, between the platforms of the two adjacent blades or vanes. A further seal 58, which comprises labyrinths, is located in the lower part of the guide vane.

Figure 2A:
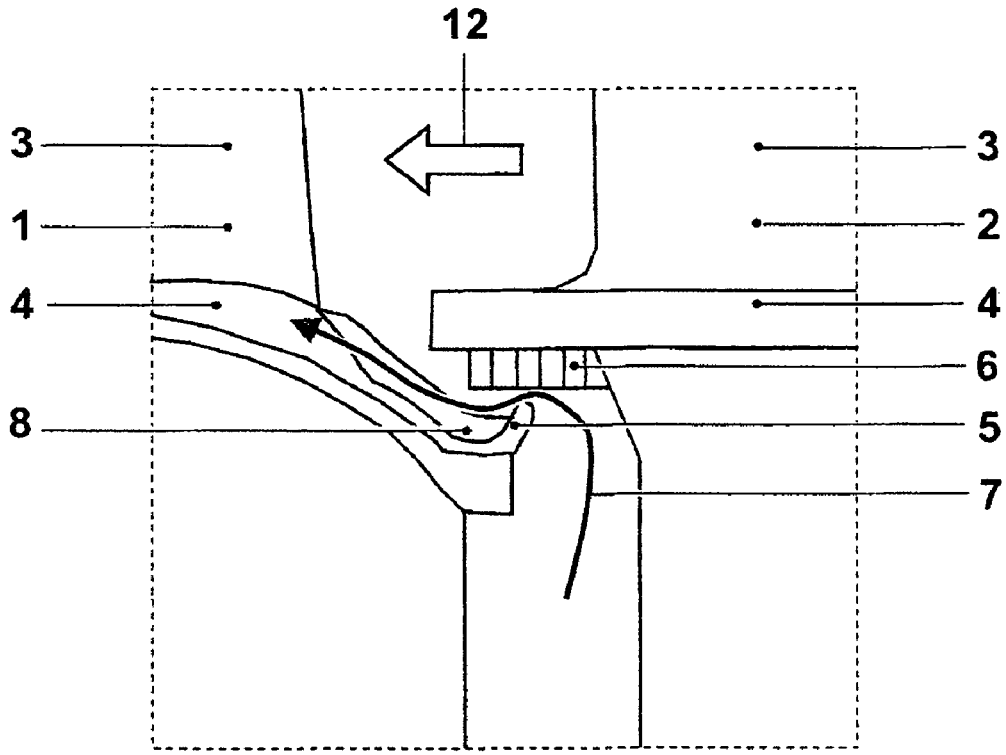
FIG. 2*a* shows excerpt II from FIG. 1, with fins in accordance with the invention in the front region of the platform of the first row of turbine blades or vanes.
Figure 2B:
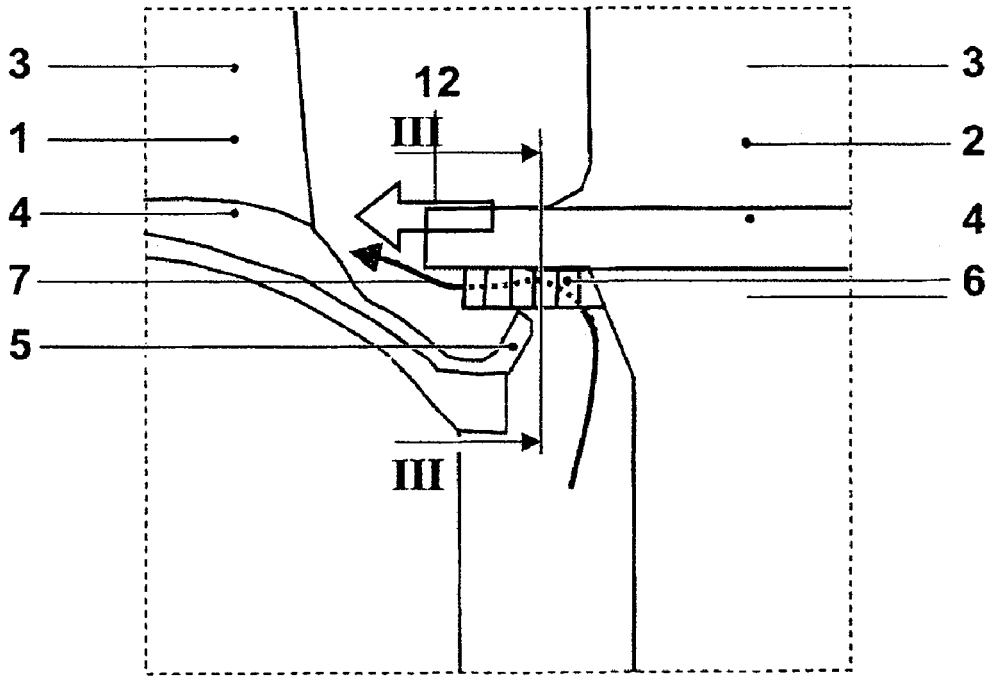
FIG. 2*b* shows excerpt II from FIG. 1 with segmented honeycombs at the underside in the rear region of the platform of the second row of turbine blades or vanes.

Working on the basis of this prior art, FIGS. 2*a* and 2*b* show the refinement in accordance with the invention of this gas turbine arrangement, corresponding to excerpt II from FIG. 1. FIG. 2*a* illustrates a row of rotor blades 1 and a row of guide vanes 2, which is arranged upstream of the row of rotor blades 2 in the direction of the hot-gas stream 12 and in the axial direction of the rotor. The guide vanes and rotor blades 1, 2 in each case have an airfoil 3 with a pressure side 10 and a suction side 11, and a platform 4. As is known from the prior art, there is a seal, which comprises a seal fin 5 and honeycombs 6, in the region of the two platforms 4. The honeycombs 6 are arranged on the underside in the rear region of the platform 4 of the row of guide vanes 2. The cooling air leakage stream 7 passes through this seal. In this first embodiment of the gas turbine arrangement according to the invention, fins 8 are arranged on the top side in the front region of the platform 4 of the first row of turbine blades 1, in order to ensure that the cooling air leakage stream 7 reaches the pressure side of the turbine blade 1. The leakage stream 7 of cooling air can in this way be put to good use, since additional cooling on the pressure side 10 of the turbine blade 1, at which experience has shown that a locally increased temperature is established, is achieved without additional outlay for providing the cooling air, i.e. without any significant influence on the efficiency of the gas turbine. The fins 8 will advantageously extend as far as the plane in which the airfoil 3 of the first row of turbine blades 1 begins, so that the cooling air leakage stream 7 is effectively prevented from flowing away to the suction side 11 of the turbine blade 1.

Figure 3:
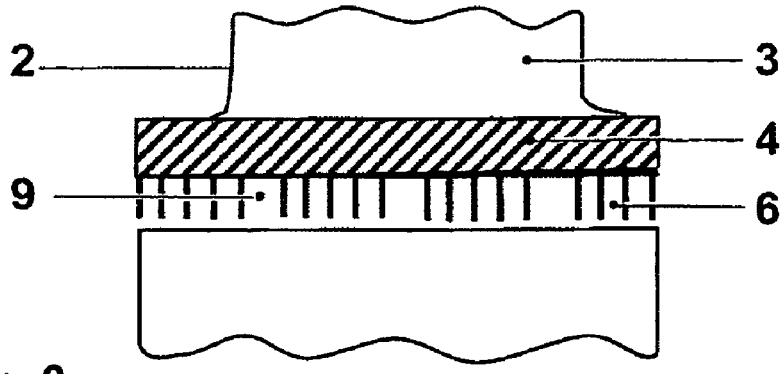
FIG. 3 shows a view on section line III—III from FIG. 2*b*.

In a second exemplary embodiment of the gas turbine arrangement according to the invention as shown in FIG. 2*a*, the honeycombs 6, which are part of the seal between the two turbine blades or vanes 1, 2 and are arranged on the underside in the rear region of the platform 4 of the second row of turbine vanes 2, comprise individual segments. As can be seen from FIG. 3, which shows a view on section line III—III from FIG. 2*b*, individual passages 9, which guide the leakage stream 7 of cooling air along the surface of the platform 4 to the pressure side 10 of the first row of turbine blades 1, are formed between the individual segments of the honeycombs 6. To prevent an additional cooling air leakage stream 7 from being formed through the passages 9, in this embodiment it may be necessary for the abovementioned labyrinth seal in the lower part of the turbine blades or vanes 1, 2 to be reinforced.

Figure 4:
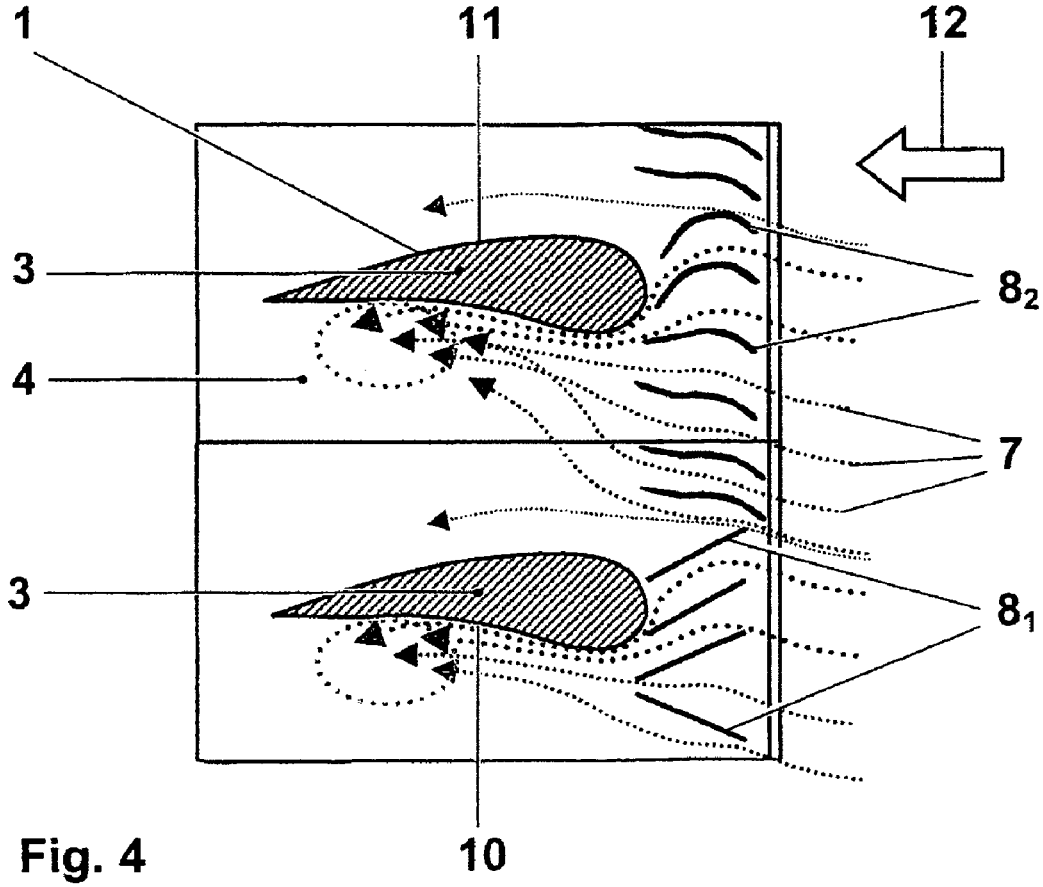
FIG. 4 shows a view on section line IV—IV from FIG. 1 through a turbine blade or vane according to the invention.

As can be seen from FIG. 4, which illustrates a view on section line IV—IV from FIG. 1 through a turbine blade or vane according to the invention, the fins 8, $\mathbf{8}_1$, $\mathbf{8}_2$ (or the passages 9 between the segments of the honeycombs 6) may be straight or curved in order to achieve the object set.

The invention also relates to a method for operating a gas turbine arrangement according to the invention, in which the cooling air leakage stream 7 which emerges between the first and second rows of turbine blades or vanes 1, 2 is guided to the pressure side 10 of the first turbine blade 1. The invention also relates to a turbine blade or vane 1, 2 for use in a gas turbine arrangement, the turbine blade or vane 1, 2 having fins 8, which point in the direction of the pressure side 10 of the turbine blade or vane 1, 2, on the top side in the front region of the platform 4. As has already been stated, these fins 8, $\mathbf{8}_1$, $\mathbf{8}_2$ may be straight or curved and may extend axially on the platform 4 as far as the plane in which the airfoil 3 of the turbine blade or vane 1, 2 begins.

The turbine blades or vanes 1, 2 in the gas turbine arrangement according to the invention and in the method according to the invention may be guide vanes or rotor blades.

LIST OF DESIGNATIONS

1 Turbine blade, rotor blade
2 Turbine vane, guide vane
3 Airfoil of turbine blade or vane 1,2
4 Platform of turbine blade or vane 1, 2
5 Sealing fin
6 Honeycomb
7 Cooling air leakage stream
8 Fin on platform 4
$\mathbf{8}_1$ Fin, straight
$\mathbf{8}_2$ Fin, curved
9 Passage in honeycomb 6
10 Pressure side of airfoil 3
11 Suction side of airfoil 3
12 Hot-gas stream While the invention has been described in detail with reference to preferred embodiments thereof, it will be apparent to one skilled in the art that various changes can be made, and equivalents employed, without departing from the scope of the invention. Each of the aforementioned documents is incorporated by reference herein in its entirety.

What is claimed is:

1. A gas turbine arrangement, comprising:

a rotor;

a hot-gas passage, through which hot gases flow while the gas turbine is operating;

at least one first row of turbine blades or vanes, which blades or vanes each have a platform and an airfoil with a suction side and a pressure side;

at least one second row of turbine blades or vanes arranged upstream of the at least one first row of turbine blades or vanes in the direction of the hot-gas stream and in the axial direction of the rotor, each blade or vane of said at least one second row of turbine blades or vanes including a platform;

at least one seal configured and arranged so that a cooling air leakage stream emerges therethrough while the gas turbine is operating, the at least one seal positioned between the first row of turbine blades or vanes and the second row of turbine blades or vanes in the region of the respective platforms; and means for guiding the leakage stream of cooling air along the surface of the platform to the pressure side of the first row of turbine blades or vanes.

2. The gas turbine arrangement as claimed in claim 1, wherein the means for guiding comprises fins arranged on of the platform facing the hot-gas passage and in a region of the platform facing the up stream direction of the hot gas flow.

3. The gas turbine arrangement as claimed in claim 2, wherein the fins extend axially on the platform as far as a plane in which the airfoil of the first row of turbine blades or vanes begins.

4. The gas turbine arrangement as claimed in claim 2, wherein the fins are straight or curved.

5. The gas turbine arrangement as claimed in claim 1, wherein the seal comprises honeycombs arranged on side of the platform facing away from the hot gas passage and in a region of the platform facing the downstream direction of the hot gas flow, the honeycombs being segmented to form passages for guiding the leakage stream of cooling air to the pressure side of the first row of turbine blades or vanes.

6. The gas turbine arrangement as claimed in claim 5, wherein the passages between the segments of the honeycombs are straight or curved.

7. A method for operating a gas turbine arrangement as claimed in claim 1, comprising:

guiding the leakage cooling air stream emerging between the first and second rows of turbine blades or vanes to the pressure side of the first turbine blades or vanes.

8. A turbine blade or vane useful in a gas turbine arrangement as claimed in claim 1, the turbine blade or vane comprising:

fins pointing in the direction of the pressure side of the turbine blade or vane, on the side of the platform facing the hot-gas passage and in a region of the platform facing the upstream direction of the gas flow.

9. The turbine blade or vane as claimed in claim 8, wherein the fins are straight or curved.

10. The turbine blade or vane as claimed in claim 8, wherein the fins extend axially on the platform as far as a plane in which the airfoil of the turbine blade or vane begins.

11. The turbine blade or vane as claimed in claim 8, wherein the turbine blade or vane comprises a guide vane or rotor blade.

* * * * *